US009458385B2

(12) United States Patent
Gordon

(10) Patent No.: US 9,458,385 B2
(45) Date of Patent: Oct. 4, 2016

(54) INTEGRATED OIL PRODUCTION AND UPGRADING USING MOLTEN ALKALI METAL

(71) Applicant: FIELD UPGRADING LIMITED, Calgary (CA)

(72) Inventor: John Howard Gordon, Salt Lake City, UT (US)

(73) Assignee: FIELD UPGRADING LIMITED, Calgary (CA)

( * ) Notice: Subject to any disclaimer, the term of this patent is extended or adjusted under 35 U.S.C. 154(b) by 268 days.

(21) Appl. No.: 13/940,336

(22) Filed: Jul. 12, 2013

(65) Prior Publication Data

US 2014/0014558 A1 Jan. 16, 2014

Related U.S. Application Data

(60) Provisional application No. 61/671,228, filed on Jul. 13, 2012.

(51) Int. Cl.

| | |
|---|---|
| ***C10G 1/00*** | (2006.01) |
| ***C10G 19/067*** | (2006.01) |
| ***C10G 19/073*** | (2006.01) |
| ***C10B 53/06*** | (2006.01) |
| ***C10G 1/02*** | (2006.01) |
| ***C10G 9/02*** | (2006.01) |

(52) U.S. Cl.

CPC ..... *C10G 1/002* (2013.01); *C10B 53/06* (2013.01); *C10G 1/02* (2013.01); *C10G 9/02* (2013.01); *C10G 19/067* (2013.01); *C10G 19/073* (2013.01)

(58) Field of Classification Search

CPC ..... C10G 1/002; C10G 1/02; C10G 1/047; C10G 9/02; C10G 19/067; C10G 19/073

See application file for complete search history.

(56) References Cited

U.S. PATENT DOCUMENTS

| | | | | |
|---|---|---|---|---|
| 4,003,823 | A * | 1/1977 | Baird et al. | 208/108 |
| 4,428,828 | A | 1/1984 | Bose | |
| 4,454,017 | A | 6/1984 | Swanson | |
| 4,500,414 | A | 2/1985 | Audeh | |
| 4,501,652 | A | 2/1985 | Le et al. | |

(Continued)

FOREIGN PATENT DOCUMENTS

| | | |
|---|---|---|
| DE | 2558505 | 11/1976 |
| KR | 2006-0032194 | 4/2006 |
| WO | WO-02099013 | 12/2002 |
| WO | WO-2010124030 | 10/2010 |
| WO | WO-2010/016899 | 11/2010 |
| WO | WO-2011012900 | 2/2011 |
| WO | WO2011053919 | 9/2011 |
| WO | WO-2012/147097 | 11/2012 |
| WO | WO2013019596 | 2/2013 |

OTHER PUBLICATIONS

Valencia, Juan C., "Notice of Allowance", U.S. Appl. No. 12/916,984, (May 7, 2014),1-9.

(Continued)

*Primary Examiner* — Renee E Robinson

(74) *Attorney, Agent, or Firm* — Foley & Lardner LLP

(57) ABSTRACT

A method that combines the oil retorting process (or other process needed to obtain/extract heavy oil or bitumen) with the process for upgrading these materials using sodium or other alkali metals. Specifically, the shale gas or other gases that are obtained from the retorting/extraction process may be introduced into the upgrading reactor and used to upgrade the oil feedstock. Also, the solid materials obtained from the reactor may be used as a fuel source, thereby providing the heat necessary for the retorting/extraction process. Other forms of integration are also disclosed.

6 Claims, 6 Drawing Sheets

(56) References Cited

U.S. PATENT DOCUMENTS

| | | | | |
|---|---|---|---|---|
| 4,548,702 | A * | 10/1985 | York et al. | 208/409 |
| 4,606,812 | A | 8/1986 | Swanson | |
| 5,328,577 | A | 7/1994 | Murphy | |
| 6,132,590 | A | 10/2000 | Moran et al. | |
| 6,280,128 | B1 | 8/2001 | Shrader | |
| 6,413,898 | B1 | 7/2002 | Faber et al. | |
| 6,635,795 | B2 | 10/2003 | Gislason et al. | |
| 6,706,902 | B2 | 3/2004 | Sturmann et al. | |
| 6,734,133 | B1 | 5/2004 | Weisbeck et al. | |
| 7,504,023 | B2 | 3/2009 | Chamberlain Pravia et al. | |
| 2002/0011430 | A1 | 1/2002 | Greaney | |
| 2002/0125175 | A1 | 9/2002 | Collins et al. | |
| 2005/0145545 | A1 | 7/2005 | Schucker | |
| 2006/0054538 | A1 | 3/2006 | Hsu et al. | |
| 2006/0138029 | A1 | 6/2006 | Malek et al. | |
| 2007/0087934 | A1 | 4/2007 | R.M. Martens et al. | |
| 2008/0031792 | A1 | 2/2008 | Ciccarelli et al. | |
| 2008/0251422 | A1 | 10/2008 | Baez et al. | |
| 2010/0187124 | A1 | 7/2010 | Koveal | |
| 2010/0276335 | A1 | 11/2010 | Shucker | |
| 2010/0297531 | A1 | 11/2010 | Liu et al. | |
| 2010/0304953 | A1 | 12/2010 | Liu et al. | |
| 2011/0054232 | A1 | 3/2011 | Sangar et al. | |
| 2011/0100874 | A1* | 5/2011 | Gordon | C10G 29/04 208/97 |
| 2011/0155647 | A1 | 6/2011 | Serban et al. | |
| 2013/0043160 | A1 | 2/2013 | Gordon | |
| 2013/0140217 | A1 | 6/2013 | Gordon et al. | |
| 2013/0153469 | A1 | 6/2013 | Gordon | |

OTHER PUBLICATIONS

Valencia, Juan C., "Notice of Allowance", U.S. Appl. No. 13/550,313, (May 8, 2014),1-8.

Oh, Eung G., "International Search Report", PCT Application No. PCT/US2014/034183 (Corresponding to U.S. Appl. No. 14/253,286; (Aug. 11, 2014),1-3.

Oh, Eung G., "Written Opinion of the International Searching Authority", PCT Application No. PCT/US2014/034183 (Corresponding to U.S. Appl. No. 14/253,286; (Aug. 11, 2014),1-6.

Lee, Chang H., "International Search Report", PCT Application No. PCT/US2014/027292 (Corresponding to U.S. Appl. No. 14/210,891; (Jul. 8, 2014),1-3.

Lee, Chang H., "Written Opinion of the International Search Authority", PCT Application No. PCT/US2014/027292 (Corresponding to U.S. Appl. No. 14/210,891; (Jul. 8, 2014),1-5.

Aizawa, Keisuke "Non-Final Office Action", Japanese Application No. 2012537170, (Aug. 26, 2014),1-6.

Lachman, Richard "Supplementary European Search Report", (Nov. 11, 2014),1-7.

"Non Final Office Action", Chinese Application No. 201080049770.5, (Jul. 1, 2014),1-4.

"Notice on Grant of Patent Right for Invention", Chinese Patent Application No. 201080049770.5, (Oct. 10, 2014),1-4.

Bearden, "Bibliographic Data", German Patent Publication DE2558505, (Nov. 18, 1976),1.

Francis, Humblot "Bibliographic data and English Abstract", Korean Patent Publication KR20060032194, (Apr. 14, 2006),1.

"Non Final Office Action", Chinese Application No. 201080049770.5, (Dec. 4, 2013),1-18.

Valencia, Juan C., "Notice of Allowance", U.S. Appl. No. 13/753,918, (Nov. 20, 2013),1-18.

"Natural Gas", http://www.gasenergia.com.br/portal/ing/gasnatural/dadostecnicos.jsp, (Jun. 10, 2004),1-20.

Sternberg, et al., "Solubilization of Coal via Reductive Alkylation", *Preprints of Papers—American Chemical Society, Division of Fuel Chemisty* (1970), 14(1), 87-94 (available to the public 1984) CODEN: ACFPAI, ISSN: 0569-3772, (1970),87-94.

Valencia, Juan C., "Non-Final Office Action", U.S. Appl. No. 12/916,984, (Sep. 10, 2013),1-10.

Valencia, Juan C., "Non Final Office Action", U.S. Appl. No. 13/550,313, (Sep. 10, 2013),1-12.

Lee, Dong W., "International Search Report", PCT Application No. PCT/US1350194 (Corresponding to U.S. Appl. No. 13/940,336), (Nov. 5, 2013),1-5.

Lee, Dong W., "Written Opinion of the International Searching Authority", PCT Application No. PCT/US1350194 (Corresponding to U.S. Appl. No. 13/940,336), (Nov. 5, 2013),1-5.

Lee, Dong W., "International Search Report", PCT Application No. PCT/US2013/026698 (Corresponding to U.S. Appl. No. 13/770,610), (Aug. 19, 2013),1-5.

Lee, Dong W., "Written Opinion of the International Searching Authority", PCT Application No. PCT/US2013/026698 (Corresponding to U.S. Appl. No. 13/770,610), (Aug. 19, 2013),1-5.

Reggel, et al., "Desulphurization of Gasoline by Metallic Sodium", *Fuel*, vol. 55, (Jul. 1976),170-172.

Byun, Sang H., "International Search Report", International Search Report for PCT US 2010/054984 (Corresponding to U.S. Appl. No. 12/916,984), (Jul. 28, 2011),1-3.

Byun, Sang H., "Written Opinion of the International Searching Authority", Written Opinion for PCT US 2010/054984 (Corresponding to U.S. Appl. No. 12/916,984), (Jul. 28, 2011),1-5.

Kabe, T. et al., "Hydrodesulfurization and Hydrodenitrogenation", *Wiley-VCH* (1999), (1999),110-112.

Task Force on Strat. UNCNV. Fuel, "America's Strategic Unconventional Fuels, vol. III Resource and Technology Profiles", *America's Strategic Unconventional Fuels, vol. III Resource and Technology Profiles* (completed Feb. 2007, Published Sep. 2007)., Full text available at http://www.unconventionalfuels.org/publications/reports/Volume_III_ResourceTechProfiles(Final).pdf,(Sep. 2007),III-25.

Lee, Young W., "International Search Report", PCT/US/2012/039388 (corresponding to U.S. Appl. No. 12/916,948), (Dec. 27, 2012),1-3.

Lee, Young W., "Written Opinion of the International Searching Authority", PCT/US/2012/039388 (corresponding to U.S. Appl. No. 12/916,948), (Dec. 27, 2012),1-3.

Yu, Jianfei et al., "High temperature naphthenic acid corrosion of steel in high TAN refining media", *Anti-Corrosion Methods and Materials*, vol. 55 Issue 5, (2008),257-63.

Wang, Chen et al., "High Temperature Naphthenic Acid Corrosion of Typical Steels", *Canadian Journal on Mechanical Sciences and Engineering* vol. 2, No, 2, (Feb. 1, 2011),23-30.

Seo, Sang Y., "International Search Report", PCT App. No. PCT/US2012/046939 (Corresponding to U.S. Appl. No. 13/550,313), (Jan. 31, 2013),1-3.

Seo, Sang Y., "Written Opinion of the International Searching Authority", PCT App. No. PCT/US2012/046939 (Corresponding to U.S. Appl. No. 13/550,313), (Jan. 31, 2013),1-6.

Hwang, Yun K., "International Search Report", PCT App. No. PCT/US2012/065670 (corresponding to U.S. Appl. No. 13/679,696), (Apr. 1, 2013),1-4.

Hwang, Yun K., "Written Opinion of the International Searching Authority", PCT App. No. PCT/US2012/065670 (corresponding to U.S. Appl. No. 13/679,696), (Apr. 1, 2013),1-8.

Valencia, Juan C., "Non-Final Office Action", U.S. Appl. No. 12/916,984, (Mar. 25, 2013),1-10.

Sternberg, et al., "On the Solubilization of Coal via Reductive Alkylation", *Preprints of Papers—American Chemical Society, Division of Fuel Chemistry* (1970), 14(1), (available to the public 1984), (1984),87-94.

Bentor, Yinon "Chemical Element.com—Sodium", http://www.chemicalelement.com/elements/na.html, (1996),1-3.

Lee, Dong W., "International Search Report", PCT/US2013/023850 (Corresponding to U.S. Appl. No. 13/753,918), (May 14, 2013),1-3.

Lee, Dong W., "Written Opinion of the International Searching Authority", PCT/US2013/023850 (Corresponding to U.S. Appl. No. 13/753,918), (May 14, 2013),1-5.

Wood, Elizabeth D., "Non-Final Office Action", U.S. Appl. No. 13/0497057, (Jul. 15, 2013),1-7.

* cited by examiner

INTEGRATED OIL PRODUCTION AND UPGRADING USING MOLTEN ALKALI METAL

RELATED APPLICATIONS

This application claims the benefit of U.S. Provisional Patent Application Ser. No. 61/671,228 filed Jul. 13, 2012. This prior patent application is expressly incorporated herein by reference.

U.S. GOVERNMENT INTEREST

This invention was made with government support under Contract No. DE-FE0000408 awarded by the U.S. Department of Energy, National Energy Technology Laboratory. The government has certain rights in the invention.

TECHNICAL FIELD

The present disclosure relates to a process for integrating a process for removing nitrogen, sulfur, and heavy metals from sulfur-, nitrogen-, and metal-bearing shale oil, bitumen, or heavy oil with a process for forming the shale oil, heavy oil, bitumen. Such an integration of these two processes provides added efficiencies that are not otherwise available.

BACKGROUND

U.S. patent application Ser. No. 12/916,984 (which has been incorporated herein by reference) has been published as United States Patent Application Publication No. 2011/0100874. The reader is presumed to be familiar with the disclosure of this published application. This published application will be referred to herein as the "874 application."

U.S. patent application Ser. No. 13/753,918 (which has been incorporated herein by reference) has been published as United States Patent Application Publication No. 2013/0140217. The reader is presumed to be familiar with the disclosure of this published application. This published application will be referred to herein as the "217 application."

Both the '217 application and the '874 application teach the utilization of hydrocarbons such as methane to attach to radicals formed when an alkali metal such as sodium reacts with the heteroatoms or metals atoms contained within the feedstock. This use of hydrocarbons in the above-recited applications replaces hydrogen gas which has traditionally been used when reacting sodium with oil. For example, U.S. Pat. Nos. 3,788,978, 3,791,966, 4,076,613 all disclose the use of hydrogen gas when sodium metal is reacted with oil.

However, the use of hydrogen with sodium and oil has several disadvantages. One such disadvantage is that the hydrogen used in these sodium/oil reactions is typically produced via the "steam methane reforming process." This process is generally discouraged because, during this process, carbon dioxide—a greenhouse gas—is emitted. Thus, alternative radical capping substances (e.g., organic materials) may be preferred over hydrogen.

When an alkali metal reacts with a petroleum feedstock and interacts with heteroatoms such as metals, sulfur and nitrogen in the feedstock, the metals, heteroatoms, etc. will be reduced to form the metals themselves as well as alkali metal sulfides and nitrides. During this reaction, organic radicals may be formed which preferably are reacted with a substance other than the same organic molecule originally bonded to the heteroatom or with another feedstock molecule. If the radical reacts with the organic molecule originally bonded to the heteroatom, undesirable coking may occur. Likewise, if the radical reacts with another feedstock molecule, undesirable polymerization may occur. For this reason, an additional radical-capping species, such as methane, etc., is used in the reaction.

It would be beneficial however, if this process for upgrading the oil feedstock material (using an alkali metal) could be integrated with the process for forming the feedstock (e.g., the process for extracting the heavy oil, oil shale, shale gas, etc.) Such "integration" could provide additional benefits and could result in increased efficiencies. Such an integration process is disclosed herein.

SUMMARY

The present embodiments relate to a method for upgrading an oil feedstock using an alkali metal, such as sodium, as a means of removing nitrogen, sulfur and heavy metals from the oil feedstock material. At the same time, this upgrading process can be integrated with other processes used to obtain the oil feedstock, thereby resulting in increased efficiencies.

The present embodiments relate to the use of radical capping substances (or radical forming substances) that will react with the oil feedstock in the presence of sodium or another alkali metal. These other radical forming substances may be more readily available than hydrogen. (These other radical forming substances would not be reactive and would not provide any benefit without the sodium.) By way of example, such radical forming substances include methane, ethane, propane, butane, pentane, hexane and their isomers. Other hydrocarbons (such as octane or other carbon containing compounds containing one or more carbon atoms) may also be used. The hydrocarbon may be a gas and may be comprised of a mixture of hydrocarbon gases (such as natural gas, or shale gas—the gas produced by retorting oil shale).

In addition to the aforementioned radical capping substances, other substances may be considered, for example: natural gas containing $H_2S$. If $H_2S$ is in the natural gas, more sodium may be required to obtain the same results since sodium reacts with the $H_2S$ in the natural gas (in addition to the reaction of sodium with the oil feedstock) to form $H_2$ and sodium sulfide. Thus $H_2S$ ultimately in the presence of sodium can provide hydrogen that can react with the radicals formed with heteroatom removal. Also, ethene, propene, butane, pentene, hexane, heptene, octane and their isomers may be used. Additionally, $H_2S$ formed in the retort process or oil production process may be utilized for this purpose.

To improve productivity, reduce overall emissions, and improve overall process economics, several opportunities exist to integrate the process of upgrading the oil feedstock with the process of extracting/obtaining the feedstock itself. For example, certain feedstocks (such as heavy oil and shale oil) also require heat during the extraction/processing. This heat is used to promote the endothermic retorting reactions of in situ or surface retort operations. It has been found that the fuel needed for this heating process can be obtained as byproducts from the upgrading process. Thus, in this manner, integrating these two processes may create efficiencies not otherwise available. With regard to oil shale, retorting is a process where the oil shale is heated directly or indirectly to temperature between 300-550° C. (in an oxygen free environment). This retorting process transforms the kerogen contained within the shale rock into oil and gas. The retorting process may be conducted batchwise, continuously, on the surface above ground or underground at the location of the oil shale deposit. If combined with the upgrading process, the upgrading process can provide the fuels necessary to provide the heat used in the retorting process.

Further, certain feedstocks, such as heavy oil, require directed heating or heating water to produce steam (for a steam assisted gravity drainage (SAGD) operation); these processes can use the byproducts of the upgrading process as the fuel necessary to create the requisite heat. Thus, integrating these two processes may create efficiencies.

Heavy oil production, or bitumen production or shale oil production are considered separate from the upgrading and typically are performed at different locations, maybe hundreds of miles apart. However, the present embodiments promote efficiency by integrating these two processes.

As mentioned above, methane, hydrogen sulfide, and shale gas and can serve as the radical capping agent needed when radicals are formed following reaction of an alkali metal with the feedstock. Gases such as methane, hydrogen sulfide and shale gas are produced during the retorting processes (as byproducts). Thus the gas formed during retorting can be used in the upgrading process if these processes are co-located and integrated.

As oil sands or bitumen or heavy oil are heated directly (or reacted using steam), methane gas and hydrogen sulfide gas may form in the process. These gases may be fed into the upgrading process where the methane may serve directly as a radical capping material. The hydrogen sulfide, in the presence of the alkali metal, will produce a quantity of hydrogen gas and this in situ formed hydrogen may act as the radical capping agent. Thus, the gases (byproducts) formed during the heating of bitumen/heavy oil may be used in the upgrading process. There are advantages to using the gases formed in the extraction of heavy oil or oil sands or bitumen by feeding those gases into the alkali metal upgrading process. An additional advantage is that the hydrogen sulfide, a poisonous gas is essentially converted to useful substances.

Similarly, when retorting oil shale, the gases formed may be used as radical capping agent in the upgrading process. An additional advantage is that often hydrogen sulfide is formed in the retorting process and the gases would require scrubbing of the hydrogen sulfide before the gases could be otherwise used. However, since upgrading with alkali metal consumes the hydrogen sulfide, the overall process becomes more efficient. For example, normally the shale gas would require considerable processing to remove the hydrogen sulfide, but this removal of the hydrogen sulfide occurs automatically in the upgrading process.

Other ways where the process integration is beneficial is where heat is required for the oil production process. This heat may be required for the generation of steam (for a steam assisted gravity drain process) or during the heating of heavy oil to reduce the viscosity. Following alkali metal upgrading and the dissolution of the alkali metal sulfide, there is a resulting solid organic matter or portion which may be 1-10% of the starting oil weight. This matter may be used as a fuel to produce the requisite heat. These solids may also be used in part as a fuel source for the retort. In addition, this matter may be fed in part or in whole back into the retort where a thermal cracking process may be assisted by the fine metals (which may be present in the solid). Feeding the solids back into the retort can provide two benefits. First, the overall liquid output can be increased. Second, the fine metals in the organic matter increase the effectiveness of the retorting process by serving as a catalyst. By increasing the effectiveness, the retort temperature may be reduced and the liquid yield may improve.

In the present embodiments, the alkali metal sulfide (formed during the upgrading process) is regenerated electrochemically (into sulfur and alkali metal) using cells with ceramic membranes. The power required to operate the cells may be produced using a generator that co-produces heat. This heat can also be used in part to provide the heat required for heavy oil or bitumen production or to heat a retort, as outlined herein. Thus, there are a variety of different ways in which the combining/integration of these processes produces efficiencies.

DETAILED DESCRIPTION

The present embodiments relate to integrating the process for obtaining/extracting an oil feedstock with a process for upgrading the oil feedstock using an alkali metal (such as a molten alkali metal). In some embodiments, the alkali metal may be sodium, lithium, potassium or alloys of these metals. The term "oil feedstock" refers to oil sources such as heavy oil, bitumen and shale oil. Typically, these oil feedstock materials are upgraded to remove sulfur, nitrogen and heavy metals contained therein. However, by integrating the "upgrading" process with the retorting or production process, as described herein, efficiencies may be achieved. As noted above, typically these two processes are done separately and at locations hundreds of miles apart; however, by performing all of these processes at the same facility, significant advantages may be obtained.

It should be noted that the upgrading process that is outlined herein is described, at length, in the '874 application and the '217 application. For purposes of brevity, much of the descriptions regarding these upgrading processes will be omitted.

Figure 1:
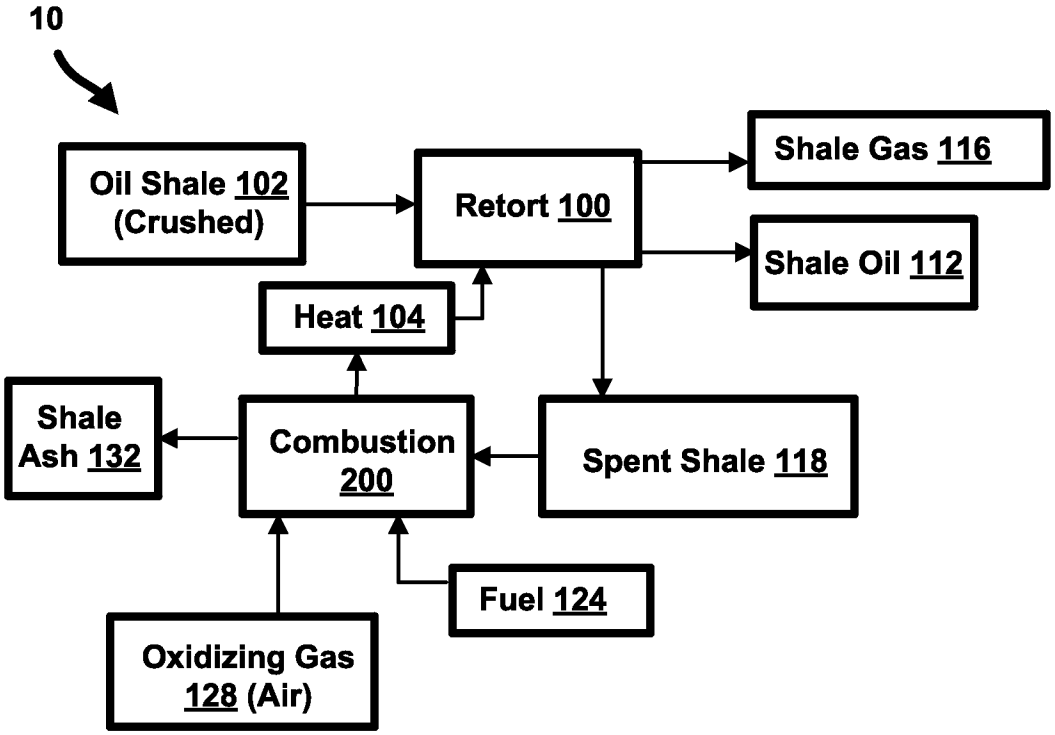
FIG. 1 shows a schematic drawing for a surface oil retorting process.

Referring now to FIG. 1, a schematic drawing for a surface oil retorting process 10 is illustrated. As shown by FIG. 1, the retort 100, receives oil shale 102 which typically has been mined, brought to the surface and crushed. (The process for mining, bringing the material to the surface and crushing the oil shale 102 is not shown in FIG. 1, but is known in the art.) The retort 100 also received heat 104 from a combustion process 200. As the oil shale 102 is heated in a substantially oxygen free environment, the organic content within the material transforms, converting to shale oil 112 and shale gas 116.

The solids leaving the retort are referred to as "spent shale" 118. The spent shale 118 may contain both organic and inorganic material and may be already warm (e.g., warm from the heat that was added during the retort process 100). The spent shale 118 may be fed into the combustion process 200 as be consumed as fuel. An additional quantity of fuel 124 may also be used in the combustion process 200. The fuel 124 may consist in part of shale gas 116, shale oil 112, or other sources. An oxidizing gas 128, typically air (but may be another gas), is fed into the combustion process 200 to react with the spent shale 118 and fuel 124. The solids leaving the combustion process 200 have very little organic composition and are then suitable for various purposes such as building material or road material. These residual solids are referred to as "shale ash" 132. Often the retort 100 and combustion 200 are integrated for more efficient heat transfer from the combustion process 200 to the retort 100.

Figure 2:
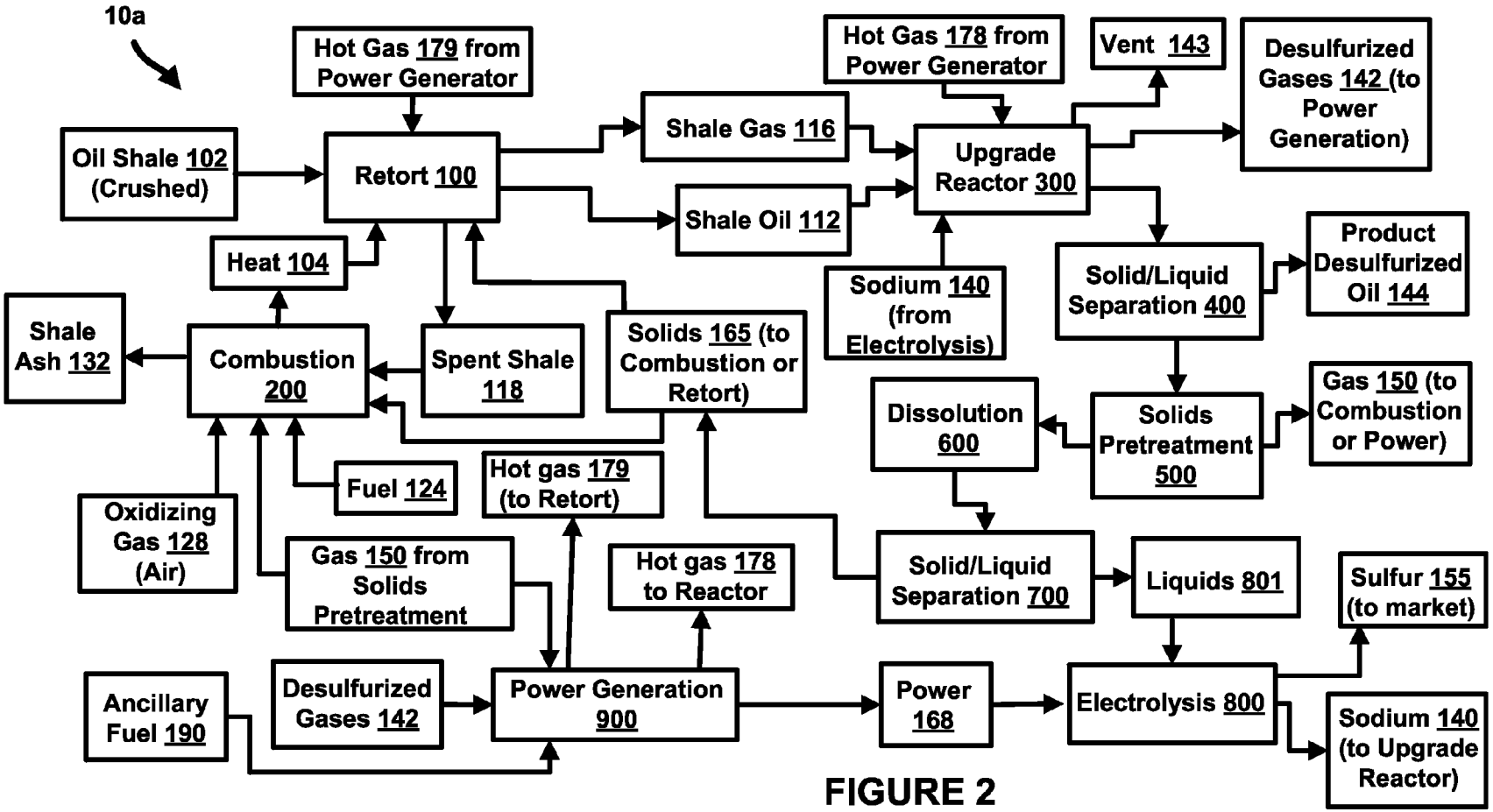
FIG. 2 shows a schematic drawing of the process of FIG. 1 that has been integrated with an upgrading process utilizing a quantity of molten alkali metal.

FIG. 2 shows a schematic drawing of the process of FIG. 1 that has been integrated with an upgrading process utilizing a quantity of molten alkali metal. Accordingly, FIG. 2 shows a surface oil retorting process 10*a* that is integrated with the upgrading technology of the '874 application. More specifically, FIG. 2 shows a process flow diagram where the same elements from FIG. 1 exist but now there is integration with an upgrading process utilizing molten alkali metal.

In the specific example of FIG. 2, sodium is the alkali metal. Of course, other alkali metals could also be used such as lithium, or potassium. There are several objectives of the upgrading process, the primary objective is to remove sulfur, nitrogen and metals from the shale oil 112. Another objective is to utilize the shale gas 116 as the radical capping agent to cap radicals formed when the sodium reacts with the sulfur, nitrogen, and metals. Utilizing shale gas 116 substantially, if not entirely, reduces the need for hydrogen which typically is used in upgrading processes. Another objective is to de-sulfurize the shale gas 116 which may contain hydrogen sulfide but will be free of hydrogen sulfide after flowing through the upgrading process which scavenges sulfur.

As shown in FIG. 2, shale gas 116 and shale oil 112 are fed into an upgrading reactor 300 as well as sodium metal 140. (The sodium metal 140 may be obtained from an electrolysis process, as will be discussed herein, thereby allowing the sodium metal 140 to be consistently reused.) As will be described herein, hot gases 178 from the power generator, may be added to the upgrade reactor 300 to facilitate the upgrading reaction. Additionally, and/or alternatively, these hot gases 179 from the power generator may also be added to the retort process 100.

The gas exiting the upgrading reactor 300 is substantially sulfur free. This gas is referred to as "desulfurized gas" 142. This sulfur-free gas 142 may then be used in a power generation process (e.g., it may be burned to provide electrical power, as desired). Other gases may also be vented off 143, as desired.

The solids and liquids from the upgrade reactor 300 move to a solid/liquid separator 400. In some embodiments, this separator 400 may comprise a filter or centrifuge, hydrocyclone, or another similar device that is designed to separate solid materials from liquid materials.

The liquids exiting the separator 400 are substantially free of sulfur, nitrogen, and metals and normally would be suitable for feed to an oil refinery. These liquid materials may be referred to as the desulfurized oil product 144. The obtained solids contain organics, sodium sulfide, and the metals originally contained in the shale oil. To facilitate separation of the sulfides from the remaining solids, they are fed to the solids pretreatment 500 according to the '217 application. This pretreatment step 500 may involve heating the solids to a temperature above 400° C. and preferably above 500° C. environment with low oxygen and water concentration, until a weight loss occurs in the solids corresponding with an increase in the carbon to hydrogen ratio. The gas 150 evolves from the solids pretreatment step 500 that is mostly methane and can be fed either to power generation 900 or to combustion 200.

Following the solids pretreatment 500, the solids are fed to dissolution 600 where the sodium sulfide dissolves cleanly from the solids. Suitable solvents include formamide, methyl formamide, dimethyl formamide, acetamide, methyl acetamide, dimethyl acetamide, ethylene glycol, propylene glycol, 1,2-ethanediol, 1,2-propanediol, propylene carbonate, ethylene carbonate, diethyl carbonate, N-methyl pyrrolidone, tetraethylene glycol dimethyl ether (tetralglyme), acetonitrile, dimethyl sulfoxide, liquid ammonia, methyl amine methyl formamide, N,N'-dimethylpropyleneurea (DMPU). Following dissolution 600 of the sodium sulfide, the solids and liquids flow to a solid liquids separation 700. This separator 700 may comprise any device that is capable of separating solids/liquids, including a filter or centrifuge, hydrocyclone. The liquids 801 flow to the electrolysis 800 where sodium is electrochemically removed from the sulfide to form elemental sodium 140 and elemental sulfur 155. This sodium 140 may then be re-used in the upgrade reactor 300, as described above. The sulfur 155 may then be sold on the open market to recuperate some costs.

The solids 165 from the solid liquid separation 700 in part may be fed back into the retort process 100. These solids 165 have an organic content contained therein. This organic content is recovered back as shale oil 112 or shale gas 116, thereby saving costs by ensuring that as much of the organic material as possible is converted into usable shale oil or shale gas. Further, any metals contained in the solids 165 may be in their elemental states and may catalyze reactions in the retort 100. These metals may then be sent to the spent shale 118.

Additionally and/or alternatively, the solids 165 (from the solid liquid separation 700) may be fed to the combustion process 200, reducing the need for fuel. As noted above, these solids 165 may have some organic content that is combustable and may serve as the fuel. Thus, the amount of fuel needed for the combustion process may be decreased.

Power 168 needed for the electrolysis 800 may come from offsite generation. However, in other embodiments, power 168 needed for the electrolysis 800 may be provided by an onsite power generation process 900. Feeding the power generation 900 may be a portion of the desulfurized gas 142 from the upgrade reactor 300. In other embodiments, shale gas 116 from the retort 100 and/or the gas 150 from the solids pretreatment 500 may also be used in addition to or in lieu of the desulfurized gas 142. An ancillary fuel 190 may also be used, if necessary, to further provide the fuel necessary for the power generation. In further embodiments, the gas 150 from the solids pretreatment 500 may be used in the combustion process 200.

The power generation process 900 will produce a quantity of hot gas. These hot gases 178, 179 may be used to heat the retort process 100 or the upgrade reactor 300. In other words, the heat in these gases 178, 179 may be used to heat up the retort process 100 and/or the upgrade reactor 300 to the desired (elevated) temperature. By using these hot gases 178, 179 to provide at least a portion of the heat needed in the retort process 100 and/or the upgrade reactor 300, the fuel requirement needed for these processes is reduced (and the overall cost of the process decreases). Further, as the hot gases 178, 179 provide some of the heat, more fuel 124 can be devoted to the combustion process 200, thereby decreasing the cost of this process.

Of course many slight changes can be made to this process flow 10*a* without changing the spirit of providing the overall benefit of integrating the retort and upgrading processes. As can be seen from this flow diagram, many of the products from one of the processes, can be used as input/heat for another process, thereby re-using as much of the materials as possible and reducing the costs.

Figure 3:
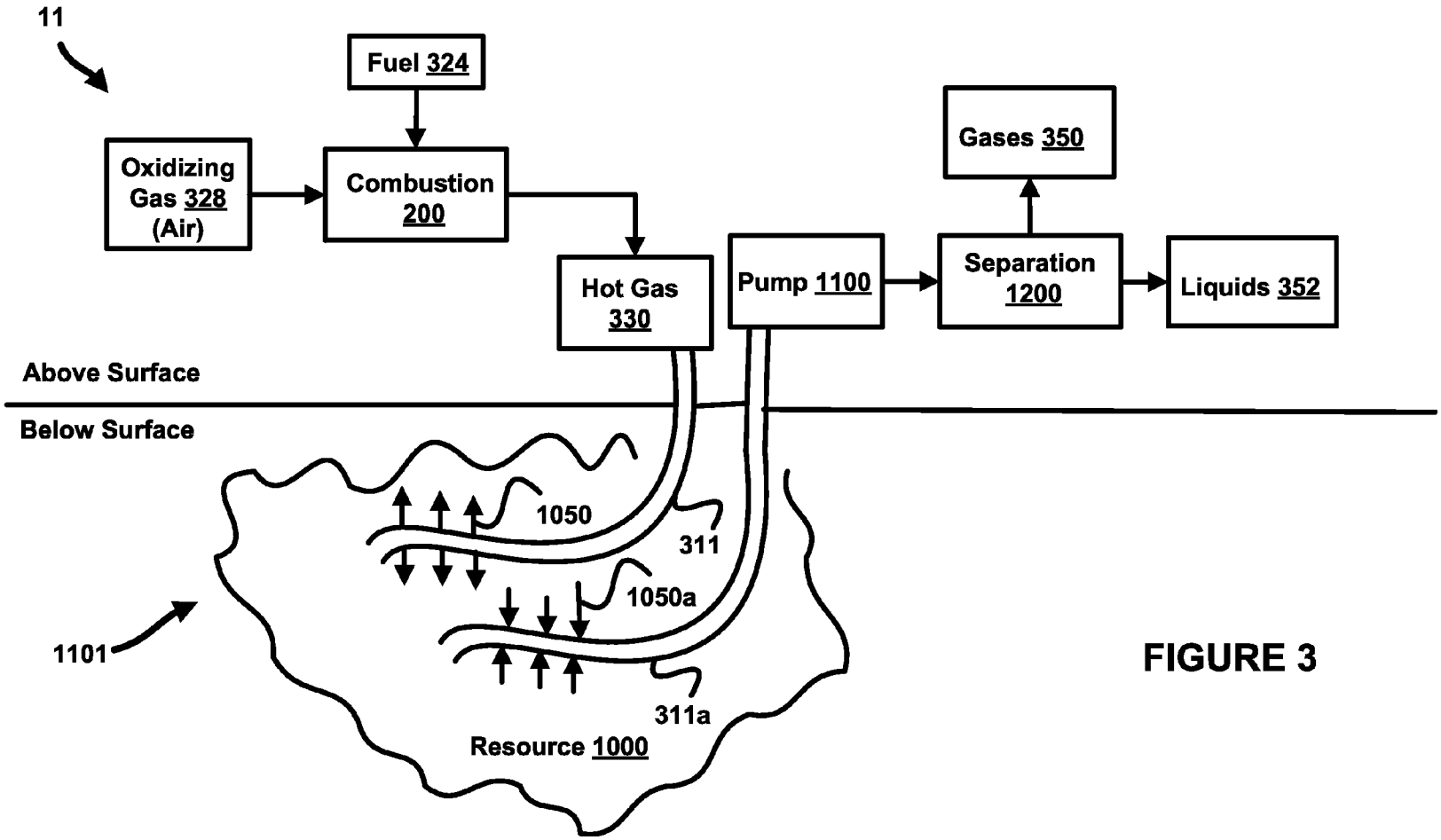
FIG. 3 shows a schematic drawing of an in situ oil retorting process or process for production of heavy oil.

Referring now to FIG. 3, a flow diagram represents a process 11 for an in situ retort or process for production of heavy oil. In this process 11, fuel 324 and oxidizing gas 328, typically air, are fed to a combustion process 200. From this combustion process, hot gas 330 is produced. This hot gas 330 is sent through one or more tubes 311 to heat an energy resource 1000 underground, in place 1101. This heating is shown by arrows 1050.

If the resource is oil shale, the organic part of the oil shale transforms into shale gas and shale oil. This transformed shale gas/shale oil then enters a second set of one or more tubes 311*a* connected to one or more pumps 1100. (This entering of the tubes 311*a* is shown by arrows 1050*a*.) Similarly, if there is heavy oil or oil sands, the same technique could be used to heat the oil in place, reducing the viscosity of the oil so it will flow through the tubes 311*a* to the pumps 1100.

Following the pumps 1100 is a separation process 1200. This process 1200 divides gases 350 from the liquids 352. Spent shale remains in place.

Figure 4:
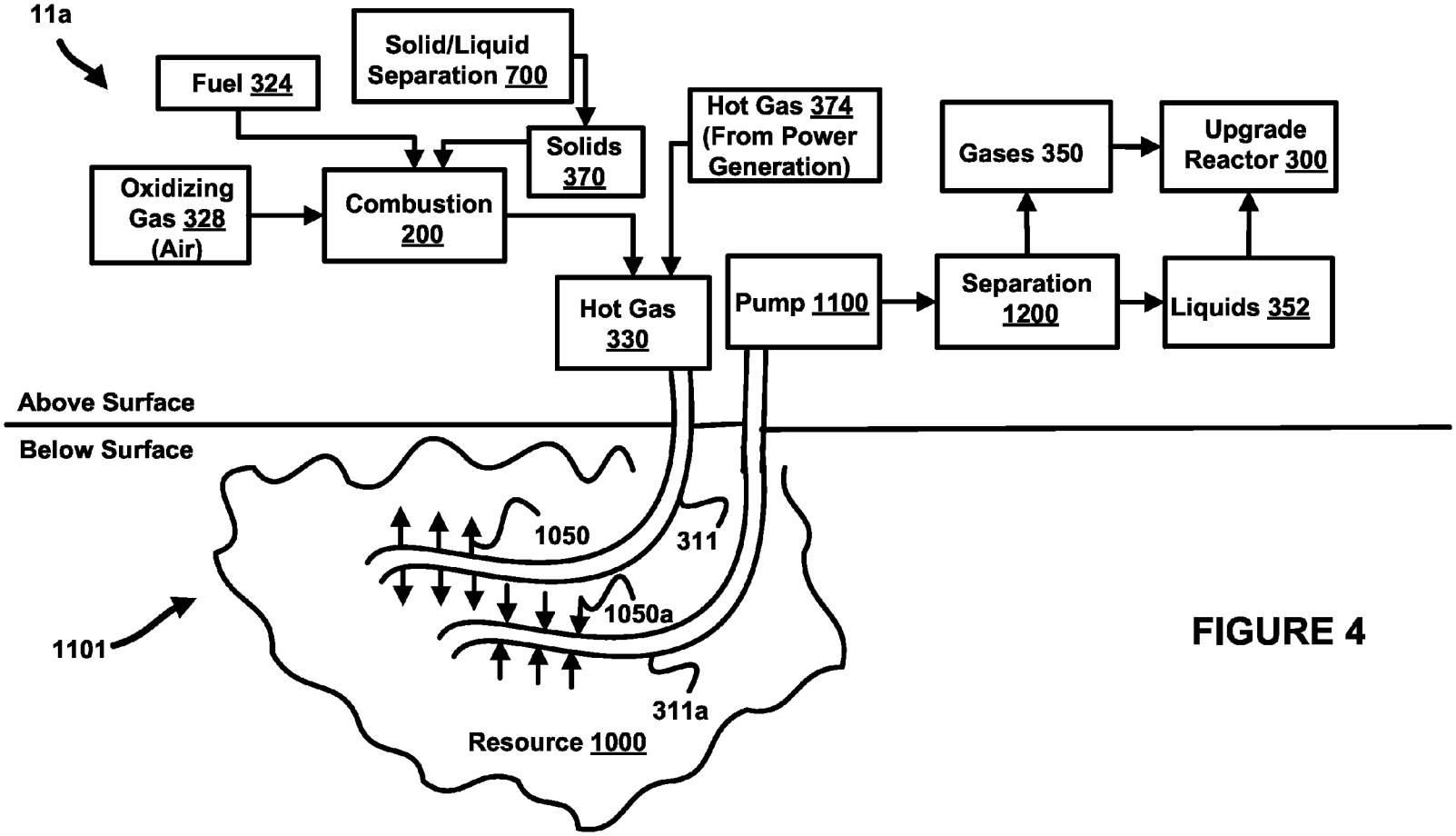
FIG. 4 shows a schematic drawing of the process of FIG. 3 that has been integrated with an upgrading process utilizing a quantity of molten alkali metal.

Referring now to FIG. 4, a flow diagram illustrates a process 11*a* that is similar to FIG. 3, except that this process 11*a* has been integrated with an upgrading process 300 (of the type described in the '874 application). Specifically, FIG. 4 shows a process flow diagram where the same elements from FIG. 3 exist but now there is integration with an upgrading process 300 utilizing molten alkali metal. Similar to the process shown in FIG. 2, the gases 350 and liquids 352 are fed to an upgrade reactor 300 where the gases are desulfurized and a portion of the gases serve as radical capping agent with the same benefits as described above.

Figure 5:
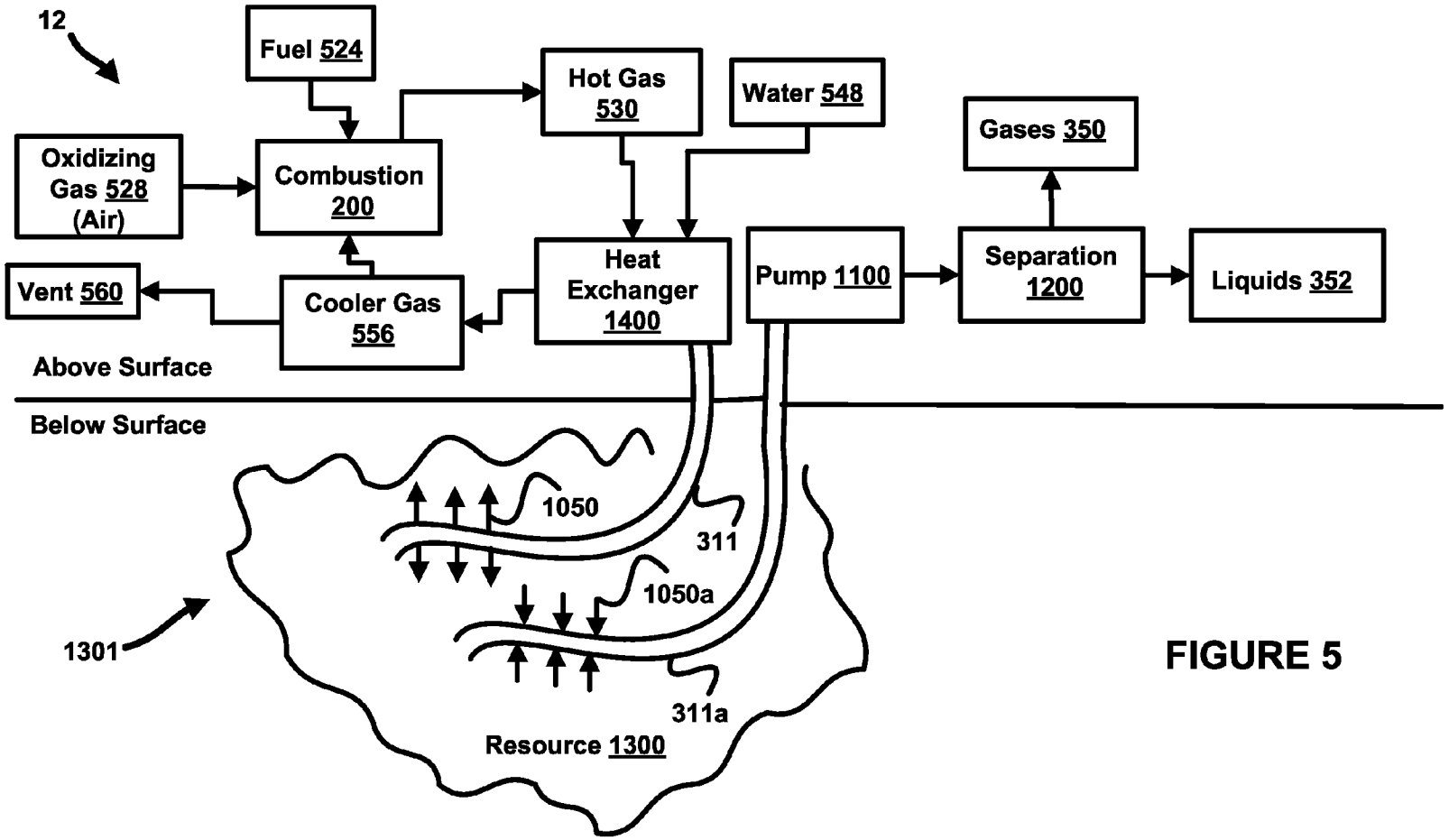
FIG. 5 shows a schematic drawing of a steam assisted gravity drain (SAGD) process for production of heavy oil or oil sands bitumen.

Similar to the process flow in FIG. 2, solids 370 from the solid liquid separation 700 may be fed to the combustion process 200 reducing the amount of fuel needed. Also hot gas from the power generation 900 (not shown in FIG. 4) may be used in addition to or in lieu of the hot gas 330. Thus, the hot gas 374 from the power generation may be sent down to the resource 1000 (via tubes 311) and reduce the demand on the combustion process 200. Of course many slight changes can be made to this process flow without changing the spirit of providing the overall benefit of integrating the retort and upgrading processes Referring now to FIG. 5, a flow diagram shows a process 12 for a steam assisted gravity drain (SAGD) that may be used in the production of heavy oil or oil sands bitumen. In this process 12, fuel 524 and an oxidizing gas 528 (typically air), are fed to a combustion process 200 that produces hot gas 530. This hot gas 530 is sent to a heat exchanger 1400 or boiler used for making steam. (Water 548 is also added to the heat exchanger 1400 and is converted into steam.) As part of this process a cooler gas is released by the heat exchanger 1400. This gas 556 may either be sent back to the combustion process 200 (e.g., as heat or as fuel) or may be vented off.

The steam is delivered through one or more tubes 311 to an energy resource 1300 that is located underground, in place 1301. The steam exiting the tubes 311 and heating the resource 1300 is shown by arrows 1050.

The resource 1300 (e.g., the heavy oil, bitumen, or oil sands) are heated in place 1301, reducing the viscosity of the oil so it will flow through the one or more pipes 311*a* to the one or more pumps 1100. (The resource entering the pipes 311*a* is shown by arrows 1050*a*.) Following the pumps 1100 is a separation 1200 occurs. This separation 1200 divide gases 350 from the liquids 352. Non fluid inorganics are left in place (e.g., in the place 1301).

Figure 6:
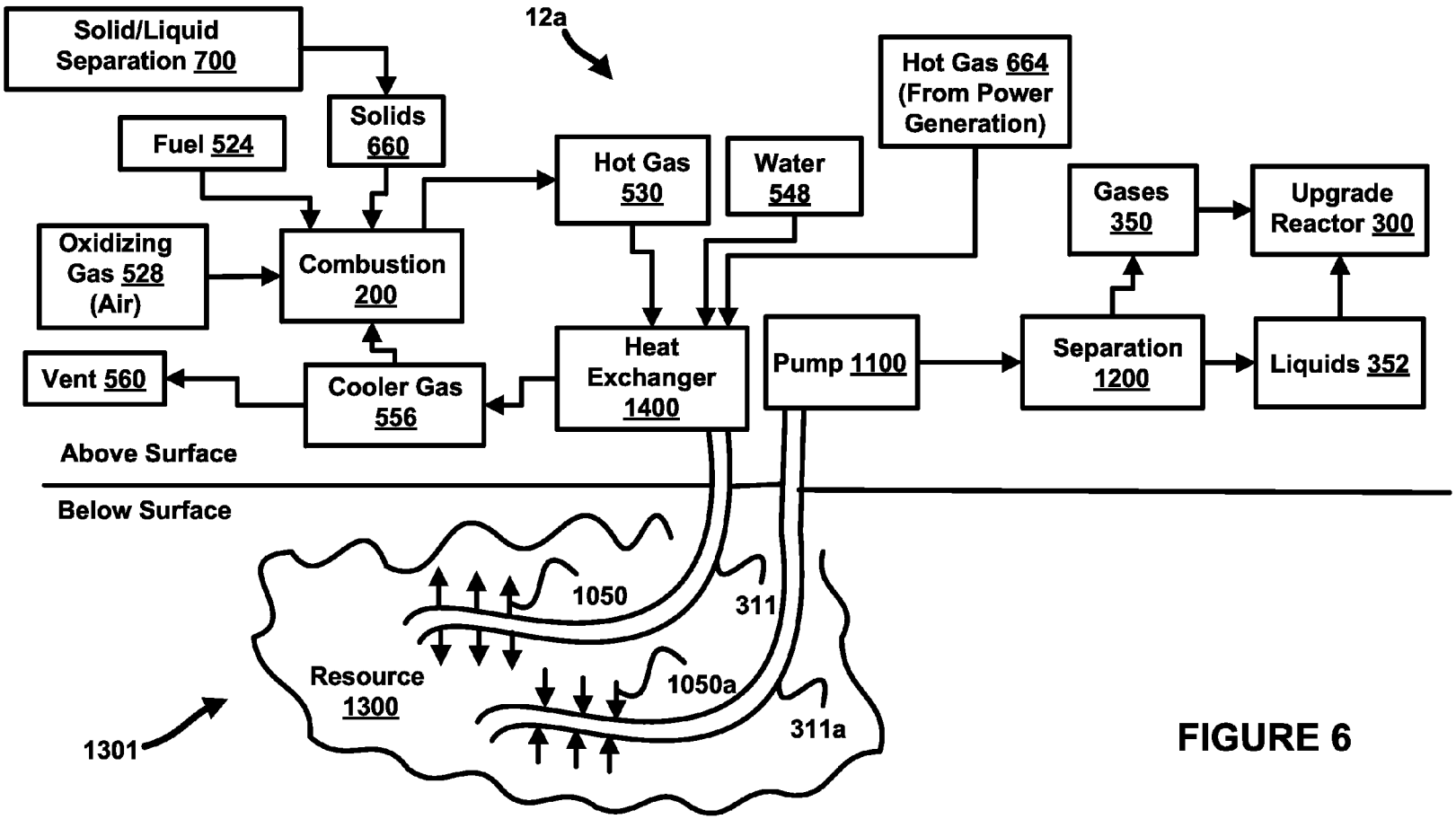
FIG. 6 shows a schematic drawing of the process of Figure that has been integrated with an upgrading process utilizing a quantity of molten alkali metal.

Referring now to FIG. 6, a flow diagram illustrates a process 12*a* that is similar to FIG. 3, except that this process 12*a* has been integrated with an upgrading process 300 (of the type described in the '874 application). More specifically, FIG. 6 shows a process flow diagram where the same elements from FIG. 5 exist but now there is integration with an upgrading process utilizing molten alkali metal.

Similar to the process shown in FIG. 2 or 4, the gases 350 and liquids 352 are fed to an upgrade reactor 300 where the gases are desulfurized and a portion of the gases serve as radical capping agent with the same benefits as described above. Similar to the process flow in FIG. 2 or 4, solids 660 from the solid liquid separation 700 may be fed to the combustion process 200 reducing the amount of fuel needed. Also hot gas 664 from the power generation 900 (not shown) may additionally be used to generate steam and reduce the demand on the combustion process 200. Of course many slight changes can be made to this process flow without changing the spirit of providing the overall benefit of integrating the retort and upgrading processes.

The integration described presently offers advantages not obvious from simply executing each technology individually. The present invention reduces the overall cost of producing gas and oil which where sulfur, nitrogen, and metals have been removed and also reduces harmful emissions such as carbon dioxide and sulfur dioxide. Simply having one process feed the other does not provide the benefits but integration as described in this invention has favorable economic and environmental impact.

Referring now to all of the Figures collectively, some of the specific efficiencies of combining an upgrading process with the retorting process and/or other process for obtaining/extracting the oil feedstock will be summarized. For example, the present embodiments relate to a method for combining a process for retorting oil shale with a process for upgrading the oil, wherein the shale gas 116 and/or the shale oil 112 that was formed during retorting oil shale process 100 is used as the gas in an alkali metal upgrading process 300. Other embodiments may be designed in which the gases 350 formed during heating of bitumen or heavy oil is used in part as the gas in an alkali metal upgrading process 300.

In other embodiments, hydrogen sulfide is produced during the process of retorting oil shale. This hydrogen sulfide may be added to the upgrading process. More specifically, the hydrogen sulfide, in the presence of the alkali metal, will produce a quantity of hydrogen gas and this in situ formed hydrogen may act as the radical capping agent. Thus, the gases (byproducts) formed during the heating of bitumen/heavy oil or the retorting process may be used in the upgrading process and do not have to be removed separately from the gases used as the "cover gas" or capping agent during the upgrading process.

In other embodiments, solids 165, which were obtained from the upgrading reaction 300, are carbon and hydrogen bearing solids. These solids 165 are fed back into a retorting process 100 or the combustion process 200, as a further fuel source for these processes. Likewise, in combined methods for producing heavy oil or bitumen from oil sands and upgrading the oil, the solids from the upgrading process are carbon and hydrogen bearing residual solids and are (at least) partially fed as a fuel for heating a heavy oil or bitumen production process.

In other embodiments, the gases 179 created during a power generation process are used as heat for an oil retorting process 100 or to heat a heavy oil or bitumen production process. In other embodiments, solids from a pretreatment process 500 downstream of the upgrade reactor are converted into gases 150 and are used, at least in part, to produce power 900 for electrolytic regeneration of alkali metals. In other embodiments, the gas formed during heating of bitumen or heavy oil is used in part to produce power 900 for electrolytic regeneration of alkali metals.

All the patent applications and patents listed herein are expressly incorporated herein by reference.

What is claimed is:

1. A method for upgrading an oil feedstock comprising:

retorting oil shale to produce shale oil and shale gas;

reacting the shale oil with an alkali metal and the shale gas obtained from the retorting step to produce upgraded shale oil, wherein the alkali metal is in the metallic state, producing alkali metal sulfide and a solid material containing organic matter during the reacting step; and producing power from the solid material for an electrolytic regeneration of the alkali metal from the alkali metal sulfide.

2. The method of claim 1, wherein the shale gas comprises hydrogen sulfide and the hydrogen sulfide is consumed during the reacting step to produce hydrogen.

3. The method of claim 1, further comprising producing a solid material containing organic matter during the reacting step, and burning the solid material as a fuel to provide heat during the retorting step.

4. The method of claim 1, further comprising producing a solid material containing organic matter during the reacting step, and, feeding the solid material back into the retorting step as a feedstock.

5. The method of claim 1, wherein the alkali metal is sodium metal.

6. The method of claim 1, wherein the alkali metal is molten sodium metal.

* * * * *